United States Patent [19]

Rorick et al.

[11] Patent Number: 4,856,731

[45] Date of Patent: Aug. 15, 1989

[54] TRAVERSE ASSEMBLY FOR USE ON TAPERED FLANGE SPOOLS

[75] Inventors: Donald E. Rorick, New Haven, Ind.; Frank M. Hayes, Hopkinsville, Ky.; Robert O. Aspy, Fort Wayne, Ind.

[73] Assignee: Phelps Dodge Industries, Inc., New York, N.Y.

[21] Appl. No.: 211,117

[22] Filed: Jun. 21, 1988

Related U.S. Application Data

[63] Continuation of Ser. No. 827,392, Feb. 10, 1986, abandoned.

[51] Int. Cl.[4] ..... B65H 54/32; B65H 54/12

[52] U.S. Cl. ..... 242/158 R; 242/16; 242/25 R; 242/158.4 R

[58] Field of Search ..... 242/158 R, 158 B, 158 F, 242/158.2, 158.4 R, 158.4 A, 158.5, 25 R, 16, 17, 47

[56] References Cited

U.S. PATENT DOCUMENTS

| | | | |
|---|---|---|---|
| 413,447 | 10/1889 | Hill | 242/16 |
| 1,846,767 | 2/1932 | Steuer et al. | 242/158 B X |
| 2,254,220 | 9/1941 | Hubbard | 242/25 R |
| 2,254,221 | 9/1941 | Hubbard | 242/25 R |
| 2,933,265 | 4/1960 | Lorenz | 242/158 R |
| 3,170,650 | 2/1965 | Bauer | 242/25 R |
| 3,391,880 | 7/1968 | White et al. | 242/158.4 R |
| 3,441,235 | 4/1969 | Sperduti | 242/158.4 R |
| 3,498,567 | 3/1970 | Baker et al. | 242/158.4 R |
| 4,130,249 | 12/1978 | Steinhilber | 242/158.4 R X |
| 4,482,100 | 11/1984 | Yoshida | 242/158 R X |
| 4,485,978 | 12/1984 | O'Connor | 242/158.4 R X |
| 4,487,373 | 12/1984 | Hatta | 242/158.4 R X |
| 4,545,549 | 10/1985 | Rundo | 242/158 B X |

*Primary Examiner*—Stanley N. Gilreath
*Attorney, Agent, or Firm*—Lundy and Walker

[57] ABSTRACT

A device for winding a strand onto a spool having at least one tapered flange comprising a strand guide and a mounting arm. The strand guide is pivotably connected to one end of the mounting arm and the strand guide is pivotable about this end. A traverse beam longitudinally travels along an axis parallel to the spool axis, the second end of the mounting arm being securely connected to the traverse. The strand guide is securely connected to one end of a lever. A wand is securely fastened to the other end of the lever. A simulated flange is dimensioned to correspond to the angular dimensions of the tapered flange on the spool, and the simulated flange is positioned such that the wand will contact the simulated flange simultaneous to the strand contacting the spool's tapered flange. A switch is located on the lever, the switch being activated upon the wand contacting the simulated flange. The switch controls a drive assembly which dictates the direction of travel of the traverse.

16 Claims, 6 Drawing Sheets

TRAVERSE ASSEMBLY FOR USE ON TAPERED FLANGE SPOOLS

This is a continuation of application Ser. No. 06/827,392, filed on Feb. 10, 1986, now abandoned.

BACKGROUND OF THE INVENTION

The subject matter of the invention relates to a traverse assembly for use on tapered flange spools and more particularly to a traverse mechanism which automatically compensates for changes in longitudinal and radial distances during the spooling process. Spooling operations, which involve winding a filamentary or ribbon like material or strand around a spool or reel like device, transcend many diverse industries. Various applications include spooling thread, yarn, ribbon, wire, cord, tape, coils or fishing line, amongst others.

Heretofore, it has been generally the practice to use a standard spool or reel having two generally flat circular flanges disposed at opposite ends of a barrel, the flanges being perpendicular to the axis of the barrel, for storing filamentary material. In recent times it has become apparent that there are several advantages to spools having tapered flanges. These advantages include ease in removing the material from the spool for purposes of customer applications, as well as eliminating damage to the material created from conventional spools in the form of scrapes, cuts, bruises or breakage due to the edges of the disc shaped flanges. With a tapered flange, the material can be removed over the angled flange end itself with less adverse effect upon the material itself.

In order to accommodate the winding and unwinding operations involving spools having tapered flanges, it became necessary to devise a mechanism which could automatically adjust for changes in the diameter of spooled material and longitudinal dimensions of traverse travel as a result of the tapered flange. The longitudinal travel required changes as more material is wound.

It is therefore highly desirable to provide a traverse assembly for use on tapered flange spools which facilitates winding or unwinding operations.

It is also highly desirable to provide a traverse assembly for use on tapered flange spools which is economically feasible and operationally efficient.

It is also highly desirable to provide a traverse assembly for use on tapered flange spools which can be readily incorporated into existing take-up machines or winders commonly used in various industries.

It is also highly desirable to provide a traverse assembly for use on tapered flange spools which can be adapted for use in operations involving both heavy filamentary materials and very delicate ones.

It is also highly desirable to provide a traverse assembly for use on tapered flange spools which can be used on both single spindle machines and gang spindle systems, as well as winding or rewinding operations.

It is also highly desirable to provide a traverse assembly for use on tapered flange spools which winds the filamentary material flat on the barrel and tight on both ends of the spool including the tapered flanges.

It is also highly desirable to provide a traverse assembly for use on tapered flange spools which eliminates overrun, fall-down, or ride-up during the spooling operation.

It is also highly desirable to provide a traverse assembly for use on tapered flange spools which automatically compensates for changes in length of wire storage area as the diameter of the spooled wire increases thus automatically controlling the spooling operation.

It is also highly desirable to provide a traverse assembly for use on tapered flange spools which automatically adjusts its own length of travel by sensing the diameter of the spooled material.

It is also highly desirable to provide a traverse assembly for use on tapered flange spools having a practical and economic method of spooling wire which can be used in high speed as well as low speed operations, including heavy industrial or very delicate operations and have all of the above features.

SUMMARY OF THE INVENTION

It is an therefore object of the invention to provide a traverse assembly for use on tapered flange spools which facilitates winding or unwinding operations.

It is also an object of the invention to provide a traverse assembly for use on tapered flange spools which is economically feasible and operationally efficient.

It is yet another object of the invention to provide a traverse assembly for use on tapered flange spools which can be readily incorporated into existing take-up machines or winders commonly used in various industries.

It is yet another object of the invention to provide a traverse assembly for use on tapered flange spools which can be adapted for use in operations involving heavy filamentary materials or very delicate ones.

It is yet another object of the invention to provide a traverse assembly for use on tapered flange spools which can be used on single spindle machines or gang spindle systems, as well as winding or rewinding operations.

It is yet another object of the invention to provide a traverse assembly for use on tapered flange spools which winds the filamentary material flat on the barrel and tight on both ends of the spool including the tapered flanges.

It is yet another object of the invention to provide a traverse assembly for use on tapered flange spools which eliminates overrun, fall-down, or ride-up during the spooling operation.

It is yet another object of the invention to provide a traverse assembly for use on tapered flange spools which automatically compensates for changes in length of wire storage area as the diameter of the spooled wire increases thus automatically controlling the spooling operation.

It is yet another object of the invention to provide a traverse assembly for use on tapered flange spools which automatically adjusts its own length of travel by sensing the diameter of the spooled material.

It is yet another object of the invention to provide a traverse assembly for use on tapered flange spools having a practical and economic method of spooling wire which can be used in high speed as well as low speed operations, including heavy industrial or very delicate operations, and have all of the above features.

Briefly, what is provided is a device for winding a strand onto a spool having at least one tapered flange comprising a strand guide and a mounting arm. The strand guide is pivotably connected to one end of the mounting arm and the strand guide is pivotable about this one end. A traverse beam longitudinally travels along an axis parallel to the spool axis, the second end of the mounting arm being securely connected to the traverse. The strand guide is securely connected to one end of a lever. A wand is securely fastened to the other end of the lever. A simulated flange is dimensioned to correspond to the angular dimensions of the tapered flange on the spool, and the simulated flange is positioned such that the wand will contact the simulated flange simulataneous to the strand contacting the spool's tapered flange. A switch is located on the lever, the switch being activated upon the wand contacting the simulated flange. The switch controls a drive assembly which dictates the direction of travel of the traverse.

BRIEF DESCRIPTION OF THE DRAWINGS

The above-mentioned and other features and objects of this invention and the manner of obtaining them will become more apparent and the invention itself will be best understood by reference to the following description of an embodiment of the invention taken in conjunction with the accompanying drawings, wherein.

DESCRIPTION OF A SPECIFIC EMBODIMENT

Figure 1:
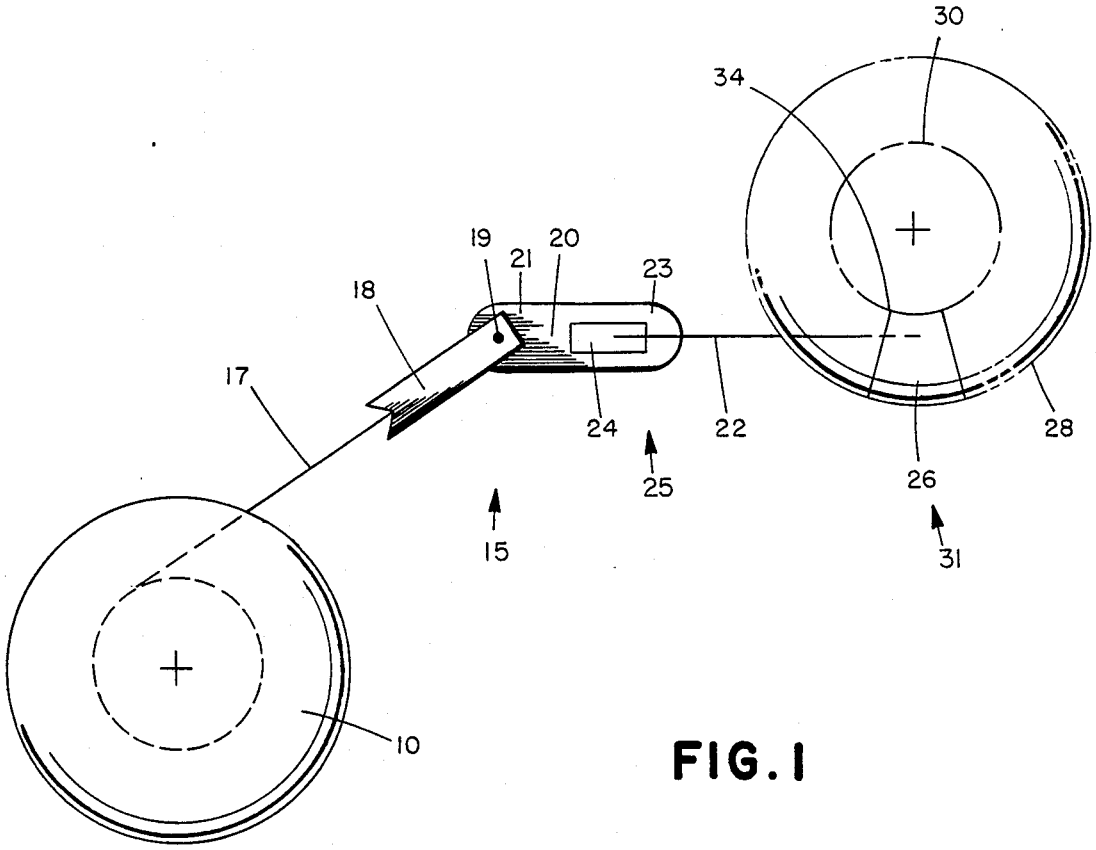
FIG. 1 is a diagrammatical view illustrating the general principles of the invention.
Figure 2:
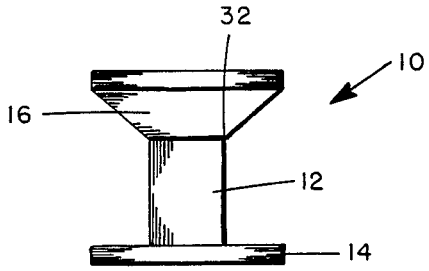
FIG. 2 is a side plan view of a spool having one tapered flange.

Referring now to FIGS. 1 and 2, the general principles of the invention are illustrated. In FIG. 2, a spool having a tapered flange is shown. Spool 10 is comprised of a barrel 12, and a flat circular flange 14 positioned at one end. At the opposite end of barrel 12, is a tapered flange 16.

FIG. 1 represents a top plan view illustrating the general principles of the invention. Tapered flange spool 10 is being wound with filamentary material 17.

It is to be understood that the present invention encompasses the spooling or winding of any filamentary material or strand including but not limited to thread, yarn, ribbon, wire, cord, tape, coil, fishing line and any other similar materials. The apparatus also has applications in heavy industrial operations or very delicate, precision operations.

The tapered flange spool 10 typically sits upon a turn table and is secured with a spindle extending upwardly, axially of the spool. As the spool or reel rotates, the filamentary material is guidingly introduced such that the spool is wound evenly and taut at all points.

Guide member 15 is composed of guide 18 and lever member 25. Strand guide 18 provides the means by which the strand is introduced to the rotating spool. Guide 18 is connected to lever member 25 which comprises lever 20 and wand 22. Strand guide 18 is attached to one end 21 of lever 20 at pivot axis or point 19. At the opposite end 23 of lever 20 is wand 22 and switch 24.

Traverse control 31 is positioned in a location such that wand 22 will contact it at a desired precise moment.

In the specific embodiment illustrated, traverse control 31 is a simulated flange 26 dimensioned such that it is an exact copy of the angular dimensions of tapered flange 16. That is, viewing tapered flange 16 of spool 10 as a frustoconical portion of a cone, simulated flange 26 is a segment cut away from tapered flange 16 with identical dimensions. The various radial and angular dimensions of the tapered flange spool 10 and the simulated flange spool 26 are identical.

In other specific embodiments, the simulated flange 26 can be dimensioned as a scaled portion of the actual tapered flange 16, e.g., on a 2:1 ratio, a 4:1 ratio, etc.

For purposes of clarity, dotted lines 28 and 30 are indicative of the location of a real flange should it be superimposed upon simulated flange 26.

Viewing strand guide 18, lever 20 and associated components as a traverse assembly, the general principles of the invention are as follows. The traverse assembly guides strand 17 onto the rotating spool 10 along the longitudinal dimension of barrel 12. As the traverse assembly travels longitudinally along barrel 12 toward tapered flange 16, the strand would initially reach and contact tapered flange 16 at point 32 of FIG. 2. At this moment in time, wand 22 would contact simulated flange 26 at point 34 of FIG. 1. Upon the wand 22 striking the simulated flange 26, the wand 22 activates switch 24 which controls the drive mechanism that dictates the direction of travel of the traverse assembly. Once the switch 24 has been activated the traverse assembly reverses direction and travels back towards the disc flange 14.

As the diameter of the spooled strand increases the longitudinal distance that the traverse assembly is required to travel likewise increases. Thus, as the spooling operation continues, the traverse assembly is successively required to travel greater longitudinal distances as a result of the tapered flange on spool 10. The traverse assembly accommodates changes in the diameter of the spooled strand by rotating or pivoting about pivot axis 19 which varies the separation of guide 18 from the axis 62 of spool 10. As strand guide 18 and lever 20 rotate about pivot axis 19 in response to movement of the strand, wand 22 is automatically repositioned to contact simulated flange 26 at a point corresponding to the point on tapered flange 16 contacted by filament 17. Thus, for example, as strand or filament 17 approaches the outer edge of tapered flange 16 during spooling operations, wand 22 likewise approaches the outer edge of simulated flange 26.

Therefore, with each successive traverse of the longitudinal dimension of barrel 12, wand 22 contacts simulated flange 26 at a spot progressively closer to the outer edge of flange 16 and thus the mechanism itself automatically adjusts for changes in radial position and longitudinal travel during operation.

The above preliminary discussion of basis concepts of the invention will now be illustrated in detail with reference to various specific embodiments of the invention.

Figure 3:
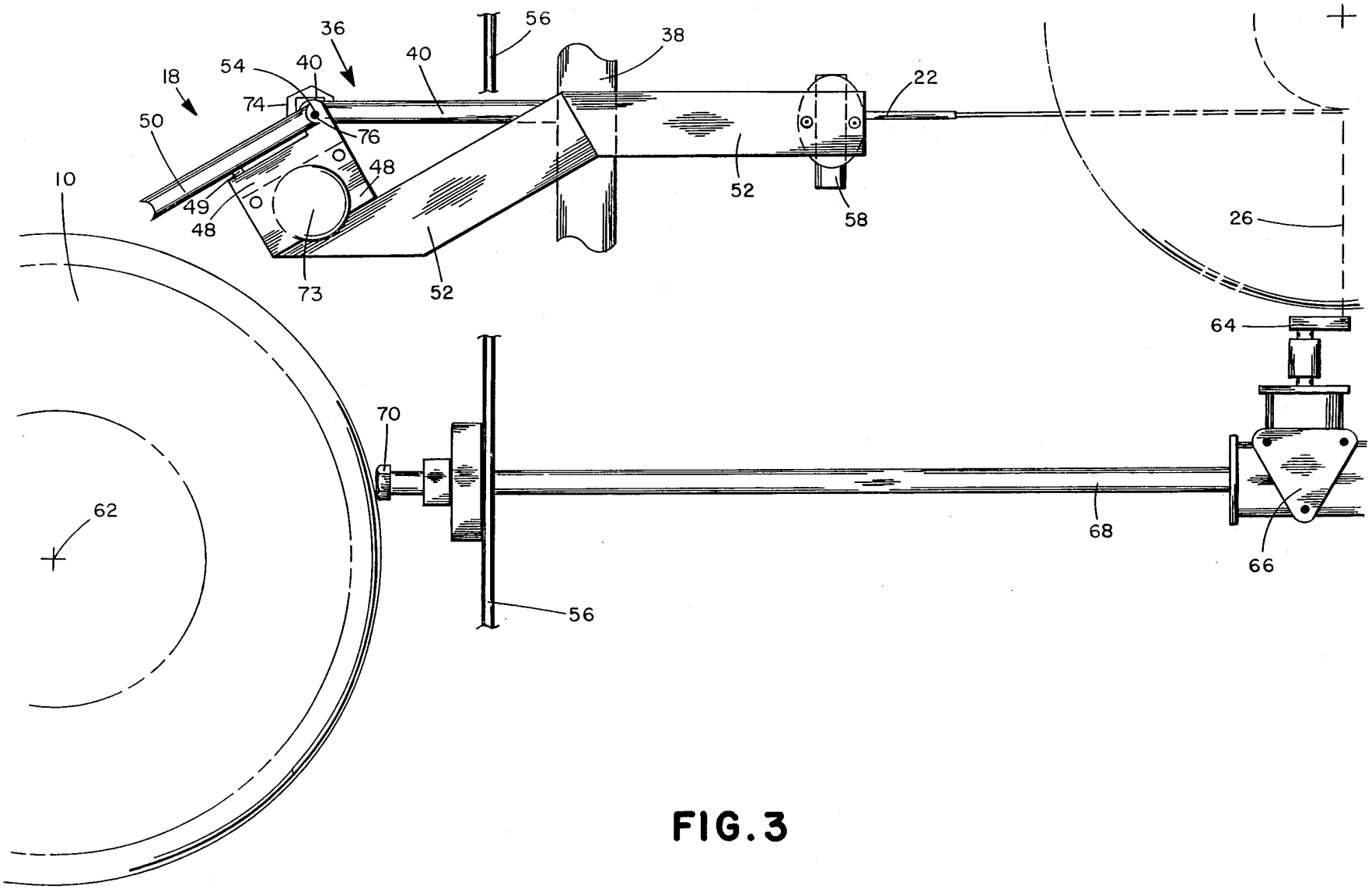
FIG. 3 is a top plan view illustrating a specific embodiment of the invention.
Figure 4:
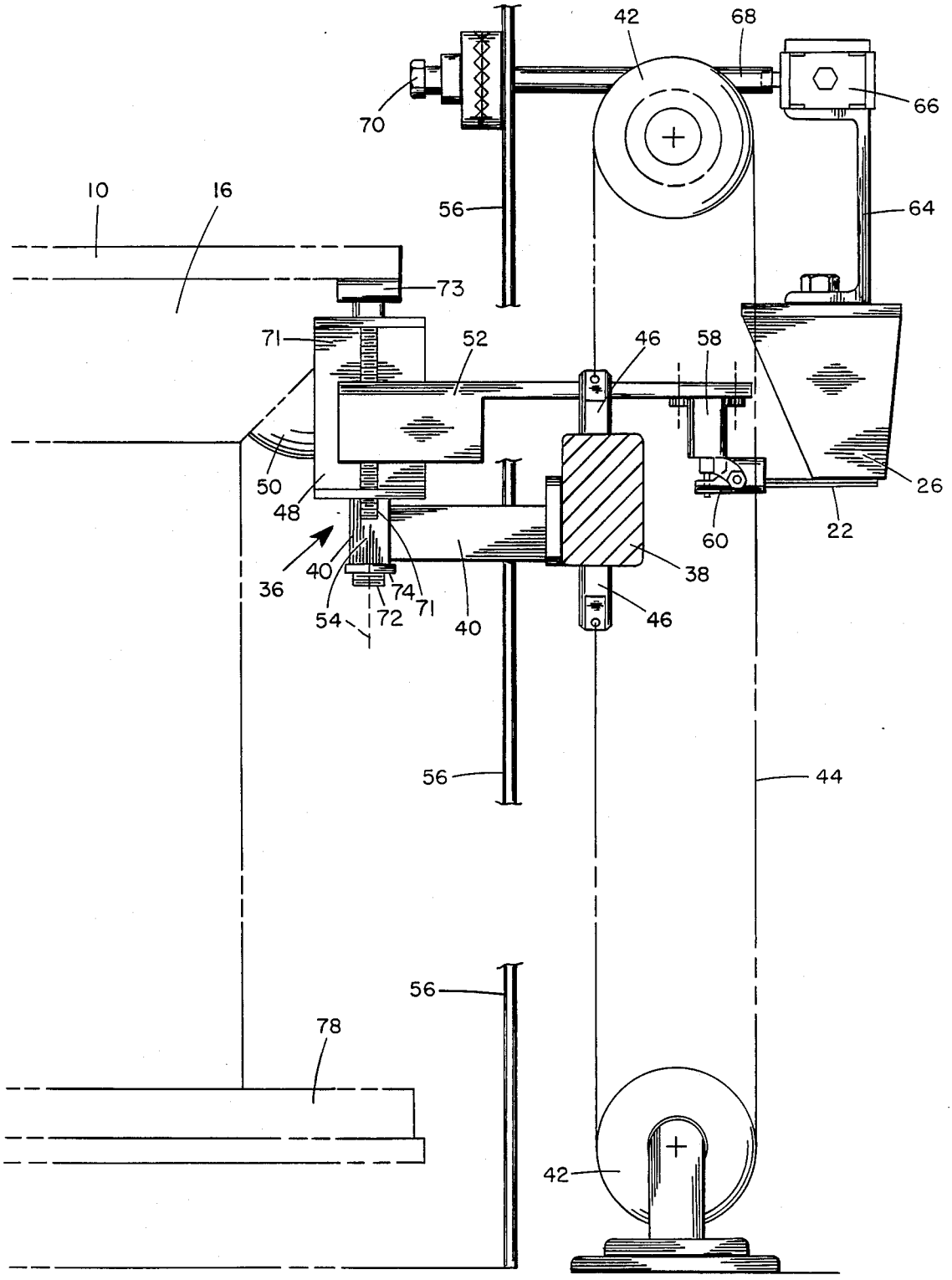
FIG. 4 is a side plan view of the invention as embodied in FIG. 3.

Referring now to FIGS. 3 and 4, a specific embodiment of the apparatus and invention is illustrated. Tapered flange spool 10 is positioned on a turntable or other device such that it is rotating during the winding operation.

The traverse assembly 36 is securely mounted to a traverse or a traverse beam 38 by mounting arm 40 by any conventional means including nuts and bolts, adhesives, welding etc. Traverse beam 38 in this particular embodiment is a horizontal beam which is conventionally used in take-up machinery, or winders, as presently used in industry. Conventional take-up machinery includes such units as manufactured by the Michigan Oven Company, M.O.C.O., or the Societa Industriale Construzioni Microelettriche Company, S.I.C.M.E.. As is readily apparent to one skilled in the art, the traverse assembly of the present invention can be readily incorporated into any existing take-up machinery used in industry, or any machinery to be developed in the future in which there is a traverse mechanism used in winding operations.

In a specific embodiment, the traverse beam 38 is caused to travel the longitudinal dimension of the barrel 12 via a sprocket chain drive assembly which includes sprockets 42 and chain 44 shown in FIG. 4. Traverse beam 38 is attached to chain 44 by threaded rod 46 which is implanted in traverse beam 38. The form of the traverse mechanism is not critical and a traverse mechanism used in any particular machinery can be adapted to receive the traverse assembly 36 via mounting arm 40. Also, any number of traverse assemblies 36 could be attached to one traverse beam 38 in a given machine. Alternatively, where there is simply one particular traverse assembly 36 per spool being wound, there would be only one traverse assembly 36 per traverse mechanism. Commonly in the industry, a gang traverse system is utilized wherein several traverse assemblies are attached to one traverse beam. The present invention can be incorporated into either a gang traverse system or a single spool system.

Mounted on the opposite end of mounting arm 40 is strand guide 18, which includes strand guide body 48, sheave 50, and sheave axle 49. Sheave 50 is rotatably connected to strand guide body 48 on one side by sheave axle 49. Lever 52 is attached to strand guide body 48.

In a specific embodiment, lever 52 can be angled, on threaded rod 71, which has knob 73 at one end, to accommodate the dimensions of the take-up machinery used and the positioning of wand 22 and simulated flange 26. The particular shape of lever 52 is not crucial and innumerable variations for particular applications come to mind for one skilled in the art.

Similarly, in a specific embodiment, sheave 50 could be directly attached to lever 52 eliminating strand guide body 48.

In the specific embodiment illustrated, strand guide body 48, and lever 52 are pivotally connected to one end of mounting arm 40 at pivot axis 54. Pivot axis 54 allows traverse assembly 36 to accommodate changes in the diameter of the spooled strand or filament as the operation progresses. Thus, in FIG. 3, as more strand or filament is spooled, the traverse assembly is rotated clock-wise about pivot axis 54 in response to movement of the strand.

Panel 56 represents the front panel of the particular take-up machinery being utilized. Panel 56 has been illustrated in cut-away portions for purposes of clarity in illustrating the present invention. Traverse beam 38, portions of traverse assembly 36, as well as the simulated flange 26 and its associated mechanism, are all located within the take-up machinery of this specific embodiment.

Microswitch 58, is located beneath one end of lever 52. Wand 22 is positioned to activate microswitch 58 through bracket assembly 60. As wand 22 comes in contact with simulated flange 26 the bracket assembly 60 mechanically activates switch 58.

Switch 58 is interfaced with the drive mechanism used in the take-up machinery. In many conventional machines, a DC motor provides the drive mechanism for a gear-sprocket-shaft assembly which, using chains or belts, drives the traverse or other mechanisms being utilized. In a specific embodiment, switch 58 could be directly wired to the drive motor. In an alternative embodiment, switch 58 could be indirectly controlling the drive mechanism. As is readily apparent to one skilled in the art, the particular drive mechanism or switch being utilized is not significant, as any drive mechanism and traverse can be adapted to be activated by any particular switch. The important consideration is that upon wand 22 contacting simulated flange 26, the wand activates a switch, the switch itself controlling the drive mechanism which reverses the direction of traverse travel. The particular switch or drive mechanism is immaterial.

As mentioned above, simulated flange 26 is a truncated segment of tapered flange 16 of spool 10. The size and dimensions of the segment portion of the simulated flange 26 are designed to accommodate incorporation within the take-up machine itself. As is obvious to one skilled in the art, a ratio relationship could be incorporated into specific embodiments wherein the simulated flange is a scaled portion of the actual tapered flange 16, for example, one-third size. The critical factor once again is wand 22 contacting simulated flange 26 at precisely the same instant in time that the strand being wound contacts the corresponding point on tapered flange 16 and simulated flange 26 being geometrically similar to flange 16. . Similarly, the dimension from the pivot axis 54 to the contact point on the simulated flange can have numerous relationships to the distance between pivot axis 54 and the spool axis 62. The same dimensions could be utilized, or some ratio thereof.

In a specific embodiment, simulated flange 26 is mounted within take-up machinery by bracket 64. Bracket 64 is connected through a journal or linkage box 66 to shaft 68. At the opposite end of shaft 68 is adjustment screw 70. Journal or linkage box 66 is securely mounted within the take-up machinery and the shaft 68 is secured at one end to the front panel 56 of the take-up machinery. Shaft 68, journal or linkage box 66, and bracket 64 provides a linkage assembly which allows shaft 68 to control the position of simulated flange 26. By adjusting screw 70, shaft 68 is caused to rotate which in turn transfers motion through journal box 66 to bracket 64 and ultimately simulated flange 26. Thus, the linkage assembly allows the simulated flange 26 to be positioned in a precise location allowing wand 22 to contact simulated flange 26 at the same moment that the strand being wound contacts tapered flange 16 of spool 10.

Simulated flange 26 must be aligned and positioned in conjunction with wand 22 such that the operation of the traverse assembly 36 is synchronized in time to properly reflect the winding operation on the spool and the distance to be traversed. Fine alignment is made possible by the linkage assembly.

Referring now to traverse assembly 36, strand guide body 48 is pivotally connected at pivot axis 54 to mounting arm 40. Threaded shaft assembly 72 provides a mechanism by which stand guide body 48 pivots around pivot axis 54. At one end of threaded shaft assembly 72 is screw cap 74 and opposite end 76 is connected in any manner which allows for free movement of assembly 72. Thus, end 76 could include a cotter pin assembly, a washer and nut assembly or any other method allowing rotation. The threaded cap 74 and shaft allows assembly unit 72 to be tightened such that the ease of rotation can be adjusted. Thus, the relative ease of which traverse assembly 36 rotates about pivot axis 54 can be aligned and adjusted to correspond to operational requirements.

In alternative specific embodiments, an adjustment mechanism need not be present, and strand guide body 48 would simply pivot about pivot axis 54 with no additional hardware being required.

The present invention is applicable to spools having one tapered flange, as well as spools having two or more tapered flanges. If a spool is utilized having tapered flanges at both ends, a similar apparatus to that described above would be utilized for the lower or second tapered flange. That is, a second simulated flange 26 would be located at the lower end of the traverse in FIG. 3. As the traverse assembly 36 approaches the lower or second end of spool 10, the wand would contact a second simulated flange and related apparatus to cause reversal in the traverse direction.

If, however, a spool is utilized having a conventional or flat disk flange 78, a conventional switching method can be incorporated into the take-up machine. The conventional switching method includes an arm which is attached to the traverse beam and a switch located within the take-up machinery near the low end of the traverse travel. As the traverse approaches the flat flange of the spool, the arm trips the switch which is wired to the motor and causes a reversal in the direction of traverse. This is a conventional stop traverse switch which has been utilized in the industry for years. In alternative specific embodiments, a stop traverse switch could be utilized at the flat flange end of the traverse which would incorporate wand 22 and interface with switch 58. Thus, switch 58 would provide the switching mechanism at both the tapered flange and flat flange ends of the traverse operation. It is immaterial whether one switch controls the entire traverse or whether two or more switches are used in conjunction.

Figure 5:
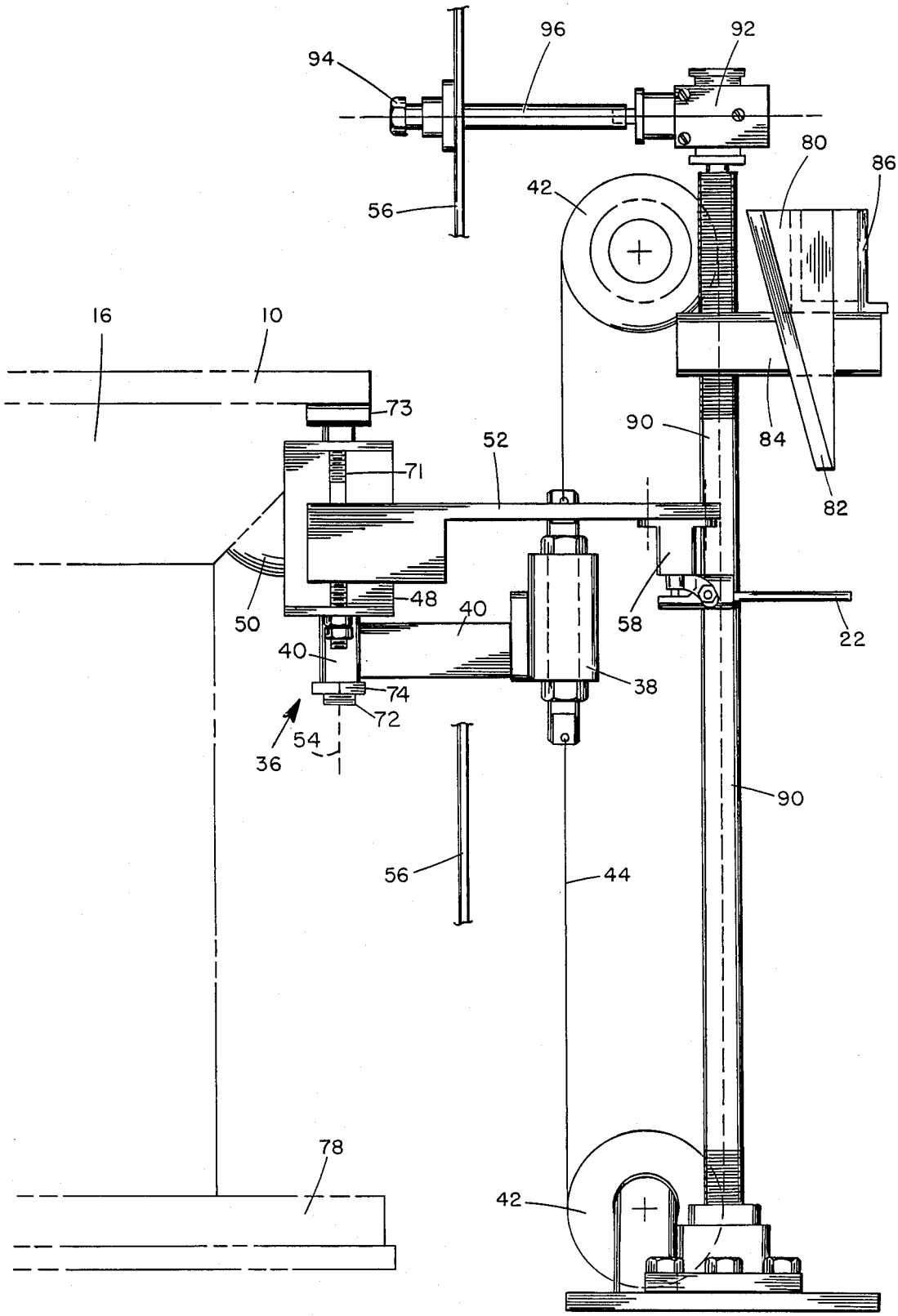
FIG. 5 is a side plan view of a modification of the invention as disclosed in FIG. 4.

Referring now to FIG. 5, an embodiment of the invention illustrating a modified simulated flange assembly is shown which provides a mechanism for adjusting the position of the simulated flange to accommodate different sized spools.

Simulated flange 80 represents a triangular segment of tapered flange 16. Face 82 is designed to simulate the angular dimension of tapered flange 16. Simulated flange 80 is attached to mounting arm 84 by bracket 86. Simulated flange 80 can be positioned anywhere along mounting arm 84 depending upon the positioning of bracket 86. Mounting arm 84 is threadably connected to threaded rod 90. Threaded rod 90 is connected at one end to journal box or linkage assembly 92. Adjustment screw 94 and shaft 96 are also rotatably connected to journal box or linkage assembly 92. By rotating adjustment screw 94, motion is transferred through shaft 96 and linkage assembly 92 to rotate threaded rod 90. Upon rotation of threaded rod 90, mounting arm 84 is vertically positioned depending upon the direction of rotation. Thus, simulated flange 80 can be aligned in conjunction with tapered flange spool 10 upon rotation of adjustment screw 94.

Traverse assembly 36 contains the same corresponding parts as those indicated in FIG. 3 including sheave 50, lever 52, traverse beam 38, wand 22 and switch 58.

As is readily apparent to one skilled in the art, there exists a myriad of methods and structure for positioning of the simulated flange incorporated in the present invention. The particular method used in any given machinery for mounting the simulated flange, as well as providing a means of adjusting the simulated flange, is not crucial. The important consideration is the synchronization such that the wand 22 contacts the simulated flange 80 at precisely the same time and precisely the same corresponding location as the strand being wound contacts tapered flange 16 of spool 10. Dimensions and structure can correspond on a one-to-one ratio, or any other ratio, depending upon the limitations of the take-up machinery being utilized as well as the particular spools, filamentary material, or application involved.

Figure 6:
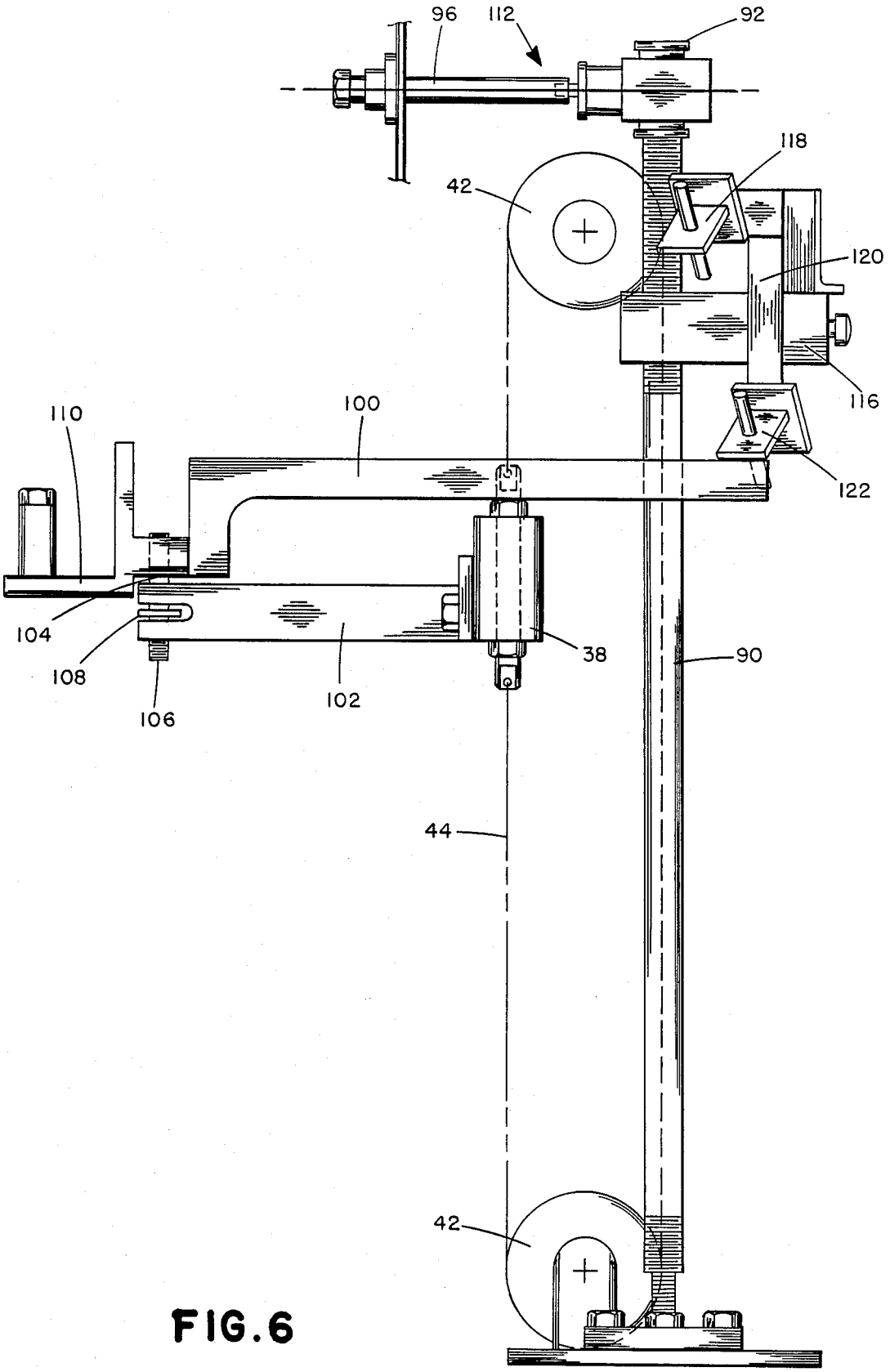
FIG. 6 is a side plan view of a modification of the invention utilizing optical devices.
Figure 7:
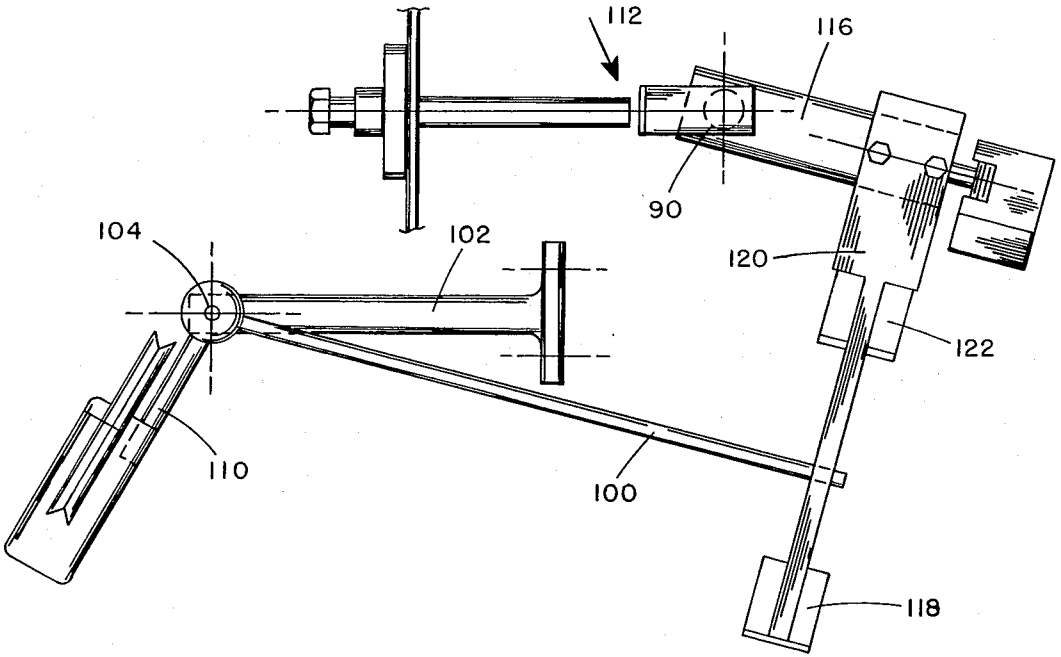
FIG. 7 is a top plan view of the invention as disclosed in FIG. 6.

Referring now to FIGS. 6 and 7, a modified version of the invention is shown which illustrates an optical sensor system. In this embodiment, lever 100 is pivotally connected to mounting arm 102 at point 104. In a particular embodiment lever 100 is mounted by pin 106 having a threaded portion for adjusting tension in conjunction with nut 108. Any particular filament or strand guide 18 can be mounted or connected to lever end 110. Traverse 38 has the same characteristics as that discussed above in connection with the earlier figures. Similarly, the journal linkage assembly 112 comprises journal linkage assembly 92 as discussed with reference to FIGS. 4 and 5, as well as rod 90 shown in FIG. 5. The optical sensor system is connected to mounting arm 116. The optical sensing system consists of light beam source 118, bracket element 120, and light beam detector 122. Beam source 118 produces an optical beam which is sensed by detector 122. Beam 118 and detector 122 are positioned such that the angular dimension from a vertical axis corresponds to the angular dimension of the tapered flange spool. Similar to the previous embodiments discussed above, the optical system is positioned on shaft 90 such that lever 100 contacts the light beam simultaneous to the strand being wound contacting the tapered flange of the spool under operation. When lever 100 contacts the light beam, a switch actuator, not shown, trips the particular switch incorporated into the invention and reverses the drive motor. Also as discussed above, the particular switch and actuator being utilized as well as the circuitry and wiring scheme used to control the drive motor are immaterial. Innumerable switches and circuitry could be incorporated into the present invention to satisfy that function. Several different switches and circuitry are presently available for this purpose.

As FIG. 6 also illustrates, the optical system can be radially or horizontally positioned in relationship to shaft 90. FIG. 7 illustrates a top view of the invention as illustrated in FIG. 6.

IN OPERATION

Referring now to FIGS. 1, 3 and 4, the operation of the invention will be described.

A tapered flange spool 10 is positioned on a turntable of a conventional take-up or winder machine in preparation for operation. Filamentary or strand material is introduced from above the take-up machinery on vertical pivot axis 54 and is wound around sheave 50 and approaches tapered flange spool 10 at a right angle to the spool axis 62. Upon rotation of spool 10 this strand is wound around barrel 12. When, for example, the traverse starts near flange 78, the strand 17 is wound around the barrel and the traverse assembly 36 travels along the longitudinal dimension of the spool 10 towards tapered flange 16. As the winding operation continues, traverse assembly 36 approaches tapered flange 16. As the strand 17 contacts a point on the tapered flange, wand 22 simultaneously contacts a corresponding point on simulated flange 26. Upon the wand 22 striking simulated flange 26, wand 22 activates switch 58 through bracket assembly 60. Switch 58 controls the drive motor and upon actuation reverses the direction of travel of traverse assembly 36. Thus, traverse assembly 36 changes direction upon actuation of switch 58. As the traverse assembly 3 approaches disc flange 78 of spool 10, a mechanical arm attached to traverse assembly 36 activates a switch in a conventional manner to again change direction of travel of the traverse assembly 36. As the diameter of the spooled strand increases, traverse assembly 36 rotates at pivot axis 54 to accommodate such increase. This rotation inherently adjusts the position that wand 22 contacts simulated flange 26 and, accordingly, automatically compensates for changes in longitudinal traverse distance. The traverse operation is thus continued until the spool 10 is filled to capacity.

It is important to note that the longitudinal distance required for the traverse assembly 36 to travel changes as the diameter of the strand 17 wound on the spool 10 increases. This is a result of the tapered flange 16. The present invention automatically compensates for changes in the diameter of the wound strand and thus automatically compensates for radial and longitudinal changes during the winding operation. As the traverse assembly 36 pivots around pivot axis 54, sheave 50 is automatically radially repositioned from spool axis 62 during operation. Likewise, compensation is automatically simultaneously made for changes in longitudinal distance because as the traverse assembly 36 rotates around pivot axis 54, wand 22 is repositioned to contact simulated flange 26 at a different point corresponding to the actual point that the strand will next contact tapered flange 16 of spool 10. Thus, the changes in the radial requirements and changes in the longitudinal requirements occur simultaneously and automatically during winding operations.

As the operation continues, the radial positioning of sheave 50 increases towards the outer end of tapered flange 16 until the spool 10 is ultimately filled to capacity. Likewise, wand 22 successively contacts simulated flange 26 at a point successively closer to the outer edge of simulated flange 26. Upon contacting the outer edge, switch 58 controls the drive motor in a manner to terminate operations.

The modified versions of the invention illustrated in FIGS. 5 and 6 operate similarly.

While there have been described above the principles of this invention in connection with specific apparatus, it is to be clearly understood that this description is made only by way of example and not as a limitation to the scope of the invention.

What is claimed is:

1. An apparatus for spooling a filamentary material onto a spool rotating about an axis having at least one tapered flange, said apparatus comprising a mounting arm having first and second ends, said mounting arm second end being a pivot point, a sheave, said sheave being generally circular and having a peripheral groove thereon, said sheave being pivotably connected to said second end of said mounting arm to automatically vary in position radially of the spool as the diameter of the spooled filamentary material increases, means for traversing said sheave longitudinally of the spool, said traversing means being connected to said first end of said mounting arm, and means for controlling relative to the tapered flange of the spool the traverse of said sheave, said spool being on one side of said sheave, said filamentary material being introduced from a path on the opposite side of said sheave, said filamentary material being guidingly engaged by said peripheral groove and being spooled at a right angle to the axis of the spool.

2. The apparatus of claim 1 wherein said traverse controlling means comprises a wand, said wand being secured to said sheave, an optical sensing system, said optical system positioned to detect said wand simultaneous to said strand contacting said spool tapered flange, a switch controlling the direction of traverse of said sheave, said switch being actuated by said optical system upon said optical system detecting said wand.

3. An aparatus for spooling a filamentary material onto a spool rotating about an axis having at least one tapered flange, said appartus comprising a lever, a guide being securely connected to said lever, means for traversing said guide longitudionally of the spool, said guide being pivotably connected to said traversing means, said guide being movable in relation to said traversing means in response to the varying radial positions of the filamentary material in relation to the spool as the diameter of the spooled filamentary material increases, a wand, said wand being securedly connected to said lever and protruding therefrom, a simulated flange, said simulated flange being dimensioned to correspond to the angular dimensions of the tapered flange, said simulated flange being positioned such that said wand contacts said simulated flange simultaneous to said filamentary material contacting the tapered flange, and means for switching the direction of travel of said traversing means, said switching means being positioned on said lever, said switching means being activated by said wand as said wand contacts said simulated flange.

4. The apparatus of claim 3 wherein said traversing means comprises a traverse beam, a sprocket assembly, said sprocket assembly including a plurality of sprockets and a chain and a drive mechanism, said sprockets positioned to drive said chain, said traverse beam being securely connected to said chain, whereby said guide and said traverse beam travel in a longitudinal path parallel to the spool axis as said sprockets drive said chain.

5. The apparatus of claim 3 wherein said switching means comprises a microswitch, said microswitch controlling said drive mechanism for said sprocket assembly.

6. A device for winding a strand onto a reel having at least one tapered flange, comprising a strand guide, a mounting arm having first and second ends, said strand guide pivotably connected to said mounting arm at said first end, said strand guide being radially positionable about said mounting arm first end, a traverse, said mounting arm second end securedly connected to said traverse, said traverse secured to a drive assembly imparting motion to said traverse longitudinally along an axis parallel to said reel axis, a lever having first and second ends, said first lever end being securely connected to said strand guide, a wand, said wand securely positioned to said lever second end, a simulated flange, said simulated flange being dimensioned to correspond to the angular dimensions of said tapered reel flange, said simulated flange being positioned such that said wand will contact said simulated flange simultaneous to said strand contacting said tapered reel flange, a switch located on said lever, said wand activating said switch as said wand contacts said simulated flange, said switch controlling said drive assembly;

whereby said traverse changes direction as said wand contacts said simulated flange compensating automatically for changes in longitudinal travel.

7. The apparatus of claim 6 wherein said strand guide is a sheave, said sheave having a peripheral groove, said sheave being rotatably connected to said first lever end, said sheave and said lever being pivotably connected to said mounting arm second end, said sheave guidingly engaging said strand, said strand being wound at a right angle to said reel axis.

8. The apparatus of claim 6 wherein said wand is secured to a bracket assembly, said wand being pivotably connected to said bracket assembly, said bracket assembly activating said switch as said wand contacts said simulated flange.

9. The apparatus of claim 6 wherein said switch is a microswitch, said microswitch controlling said drive assembly.

10. The apparatus of claim 3 or 6 wherein said simulated flange is a truncated segment of a tapered spool flange, said truncated segment having an angled section, said angled section being dimensioned to relate to the angular dimension of said tapered flange.

11. An apparatus for spooling filamentary material onto a spool having at least one tapered flange, said apparatus comprising a lever, a guide connected to said lever, said guide introducing said filamentary material onto said spool, means for traversing said guide longitudinally of said spool, said traversing means being connected to said lever a traverse control spaced from said spool, said traverse control disposed to be contacted by said lever simultaneous to said filamentary material contacting said tapered flange, and means for switching the direction of travel of said traversing means, said switching means being actuated by said lever contacting said traverse control.

12. The apparatus of claim 11 wherein said traverse control is dimensioned to relate to the dimensions of said tapered flange.

13. The apparatus of claim 11 wherein said traverse control is an optical system having a light beam disposed to be contacted by said lever simultaneous to said filamentary material contacting said tapered flange.

14. The apparatus of claim 11 wherein said guide is pivotable by said filamentary material introduced onto said spool about a pivot axis.

15. The apparatus of claim 14 wherein said guide further comprises a sheave engaging said filamentary material at said pivot axis, and a sheave axle about which said sheave rotates.

16. The apparatus of claim 15 wherein said pivot axis is generally parallel to the axis to the spool and wherein said sheave axle is generally perpendicular to said pivot axis.

* * * * *